US006604586B2

(12) United States Patent
Tremblay

(10) Patent No.: US 6,604,586 B2
(45) Date of Patent: Aug. 12, 2003

(54) DRILLING APPARATUS

(75) Inventor: Harvey Tremblay, Smithers (CA)

(73) Assignee: Hy-Tech Drilling Ltd., Smithers (CA)

( * ) Notice: Subject to any disclaimer, the term of this patent is extended or adjusted under 35 U.S.C. 154(b) by 0 days.

(21) Appl. No.: 09/891,563

(22) Filed: Jun. 27, 2001

(65) Prior Publication Data

US 2002/0117336 A1 Aug. 29, 2002

(30) Foreign Application Priority Data

Feb. 27, 2001 (CA) ..... 2338823

(51) Int. Cl.[7] ..... E21B 7/20; E21B 7/26; E21B 10/64; E21B 19/08

(52) U.S. Cl. ..... 175/171; 175/19; 175/202; 175/203; 175/258; 173/185

(58) Field of Search ..... 175/162, 171, 175/195, 202, 203, 226, 257, 258, 19, 23; 173/185, 152, 141, 43, 44, 42, 22, 39, 164

(56) References Cited

U.S. PATENT DOCUMENTS 3,664,436 A * 5/1972 Beagan, Jr. ..... 173/193
3,730,285 A * 5/1973 Anderson et al. ..... 175/122
3,734,212 A * 5/1973 Perlewitz ..... 173/197
3,809,344 A * 5/1974 Kolderup et al. ..... 173/185
4,096,608 A * 6/1978 Lagerstedt ..... 166/77.51
4,703,811 A * 11/1987 Lam ..... 173/164
4,843,785 A * 7/1989 Sero et al. ..... 53/236
5,213,169 A * 5/1993 Heller ..... 173/185
5,263,545 A * 11/1993 Tudora et al. ..... 175/171
5,431,234 A * 7/1995 Klemm ..... 173/152
5,575,344 A * 11/1996 Wireman ..... 175/162
5,660,504 A * 8/1997 Reinert, Sr. ..... 173/184
5,709,277 A * 1/1998 Geldner ..... 173/38
5,803,189 A * 9/1998 Geldner ..... 175/113
5,944,452 A * 8/1999 Reinert, Sr. ..... 173/184
2001/0009205 A1 * 7/2001 Borgman ..... 175/122

FOREIGN PATENT DOCUMENTS

DE 3445970 A1 * 6/1986 ..... E21C/9/00
WO WO 9219837 A2 * 11/1992 ..... E21B/7/02

* cited by examiner

*Primary Examiner*—David Bagnell
*Assistant Examiner*—Jennifer H Gay
(74) *Attorney, Agent, or Firm*—George A. Seaby

(57) ABSTRACT

A drilling apparatus includes a platform for positioning at a drilling site) a mast pivotally mounted on the platform) a rod clamp on one end of the mast for clamping a drill rod) a drill head slidably mounted on the mast for driving the drill rod during a drilling operation, a main ram connected to said mast and said drill head for moving the drill head longitudinally of the mast) a casing clamp on the rod clamp for clamping the mast to a top end of a casing carrying the rod) whereby the mast is anchored to the ground during drilling) and a drill head slidable on the mast for driving the drill rod during drilling.

5 Claims, 11 Drawing Sheets

DRILLING APPARATUS

BACKGROUND OF THE INVENTION

1. Field of the Invention

This invention relates to a drilling apparatus.

2. Discussion of the Prior Art

Currently available diamond drilling rigs are usually large, heavy assemblies, which are susceptible to movement during drilling. Such rigs, which are intended to deep well drilling (2000–3000 feet) include a derrick mounted on a platform fur supporting the remaining elements of the rig. During drilling on soft ground, the reaction between the drill string and the derrick tends to push the platform upwardly. When pulling the drill string upwardly, the platform tends to sink into the ground. In either case, the derrick and consequently the drill string can become misaligned with the borehole or well.

GENERAL DESCRIPTION OF THE INVENTION

An object of the present invention is to provide a solution to the above-identified problem in the form of a relatively simple, portable drilling apparatus which can be anchored to the bedrock during drilling or core sample removal, and consequently cannot become misaligned due to reaction forces between the drill and the rock.

Another object of the invention is to provide a lightweight, modular drilling apparatus, which is easy to assemble and disassemble. A lightweight modular apparatus of the type described herein is air portable. The elements of the apparatus can be delivered in the order in which they are to be assembled by helicopter to a drilling site where the apparatus is quickly put together in a matter of hours. Upon completion of a drilling operation, the process is reversed, and the elements of the apparatus can be expeditiously removed from the drilling site. There is no need for a large heavy derrick, which cannot be assembled and disassembled in a short time.

Accordingly, the invention relates specifically to a drilling apparatus for use with a well casing anchored in the ground at the start of a drilling operation, and a platform for positioning at a drilling site, said apparatus comprising:

(a) a mast for mounting on said platform for rotation between a horizontal use position and an inclined or vertical drilling position;

(b) a rod clamp fixedly mounted on one end of said mast for clamping a drill rod during a drilling operation;

(c) a casing clamp on said one end of said mast for clamping said mast to a top end of said casing, whereby the mast is anchored to the ground during drilling operation;

(d) a drill head slidably mounted on said mast for movement toward and away from said rod clamp, said drill head being adapted to drive a drill rod during a drilling operation; and (e) a main ram connected to said mast and said drill head for moving said drill head longitudinally of the mast during a drilling operation.

BRIEF DESCRIPTION OF THE DRAWINGS

The invention is described below in greater detail with reference to the accompanying drawings, which illustrate a preferred embodiment of the invention and wherein.

DESCRIPTION OF THE PREFERRED EMBODIMENT

Figure 1:
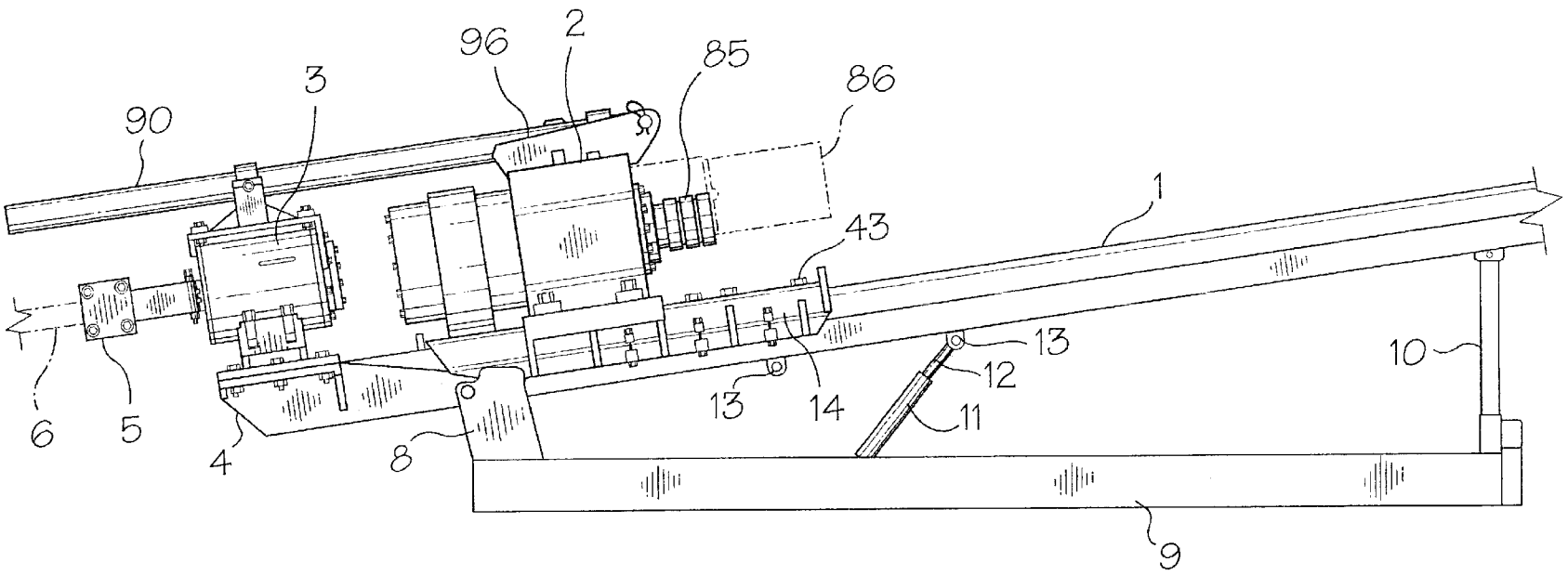
FIG. 1 is a side view of a drilling apparatus in accordance with the invention.
Figure 2:
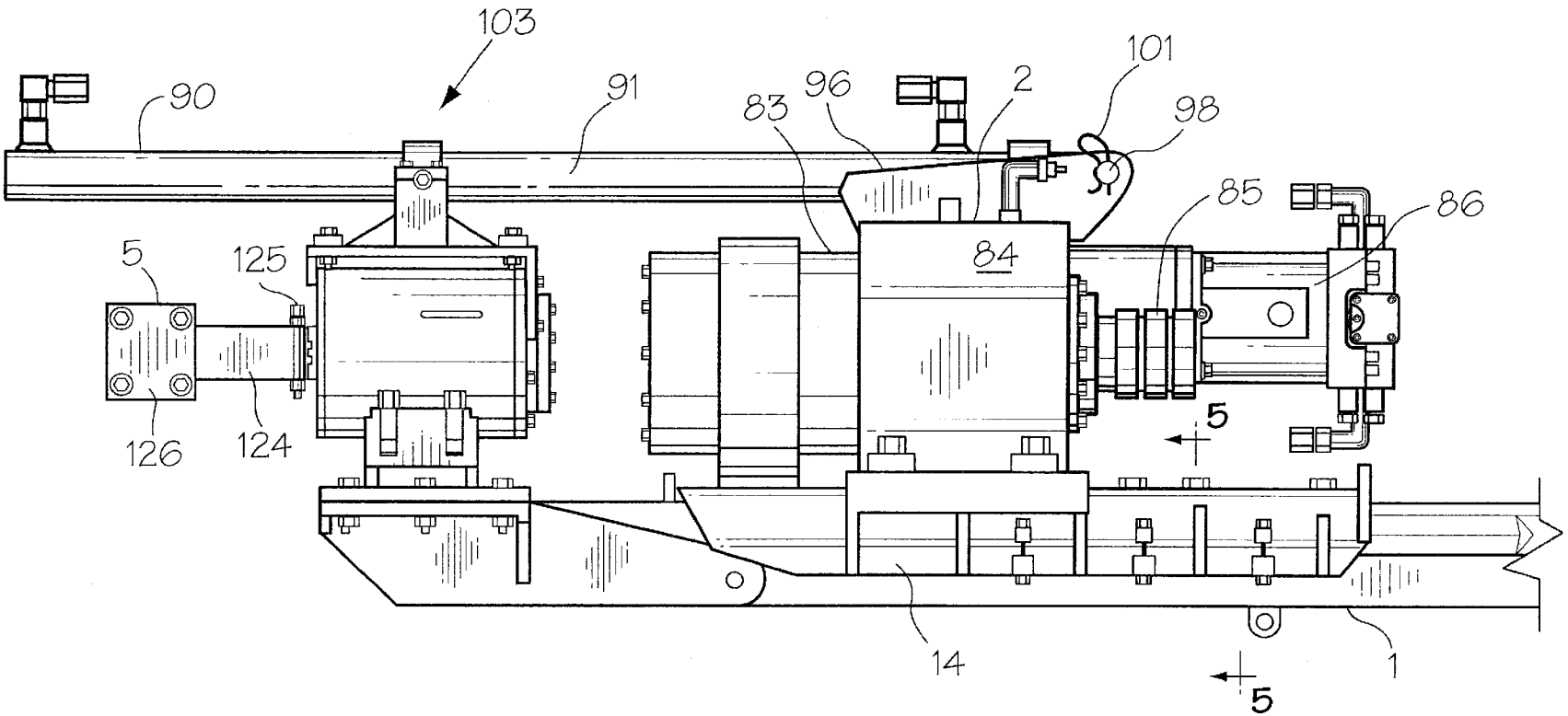
FIG. 2 is a side view on a larger scale of one end of the apparatus of FIG. 1.
Figure 3:
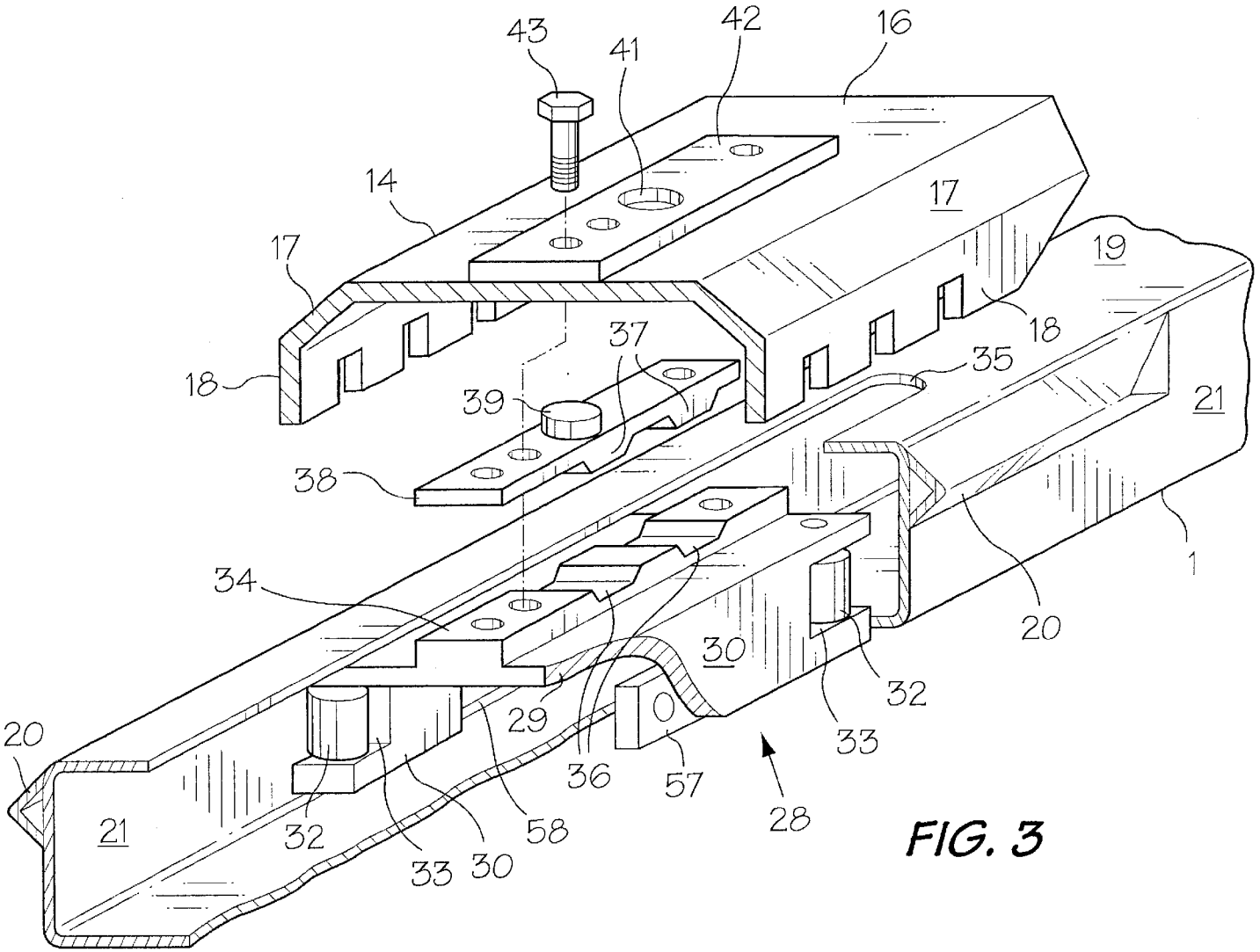
FIG. 3 is a partly sectioned, perspective view of a mast, saddle and carriage used in the apparatus of FIGS. 1 and 2.

Referring to FIGS. 1 and 2, the basic elements of the drilling apparatus include an elongated mast 1 for slidably supporting a drill head 2, a rod clamp 3 mounted on one end 4 of the mast 1, and a casing clamp 5 for securing the mast and consequently the remainder of the apparatus to the top end of a well casing 6 (FIGS. 1 and 3).

The mast 1 is pivotally mounted on a post 8 at one end of a platform 9 for rotation between a rest position (FIG. 1) and a vertical position (not shown). In the rest position, the mast 1 is supported by a cradle 10 at the other end of the platform 9. The mast 1 is raised using a hydraulic ram 11, the bottom end of which is pivotally connected to a crossbar (not shown) in the platform 9. The top end of a piston rod 12 extending out of the cylinder is pivotally connected to one of two devises 13 on the bottom of the mast 1. One clevis 13 is used to raise the mast 1 through 45° and the over clevis 13 (on the left in FIG. 1) is used to raise the mast 1 to the vertical position.

Figure 5:
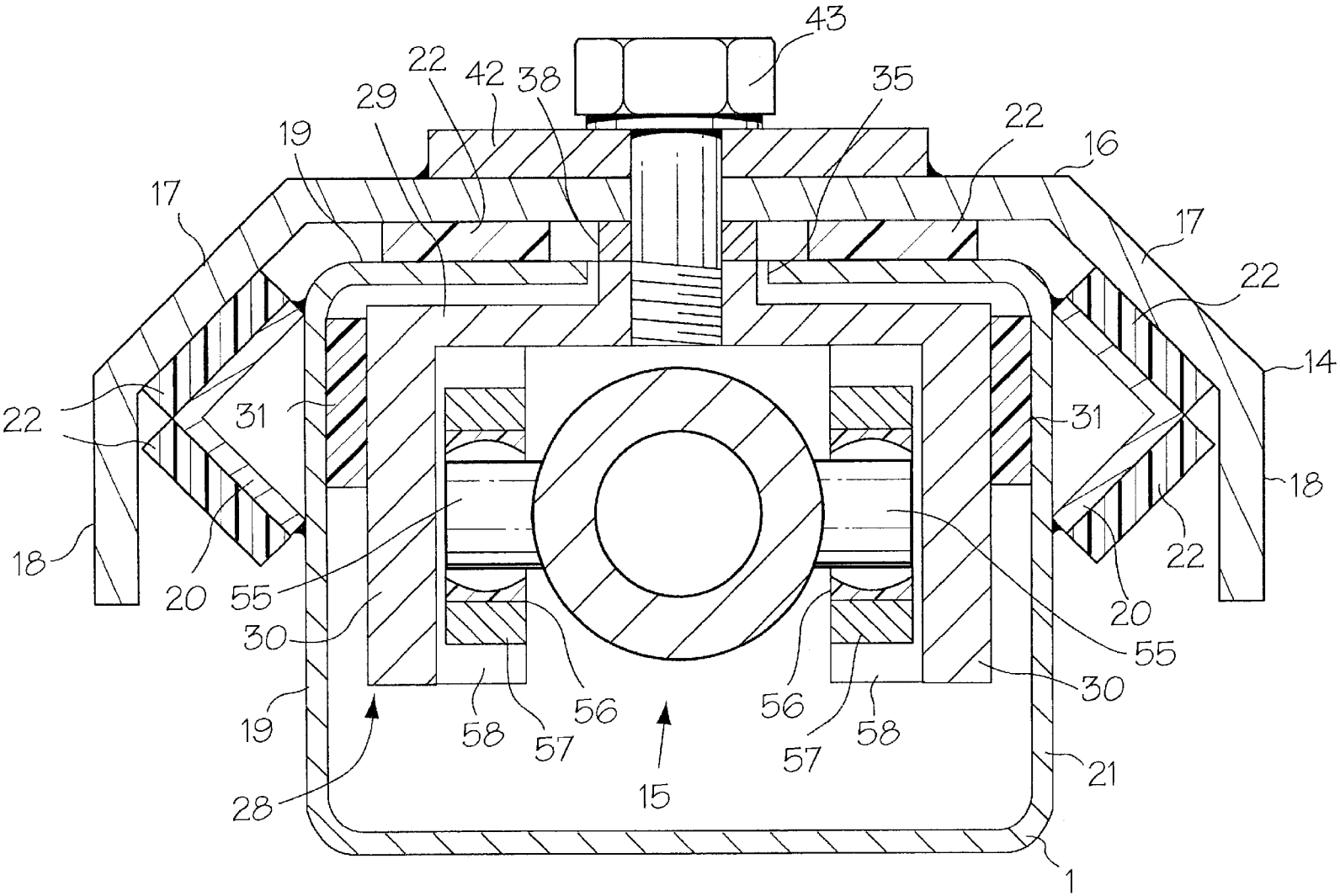
FIG. 5 is a cross section taken generally along line 5—5 of FIG. 2.
Figure 6:
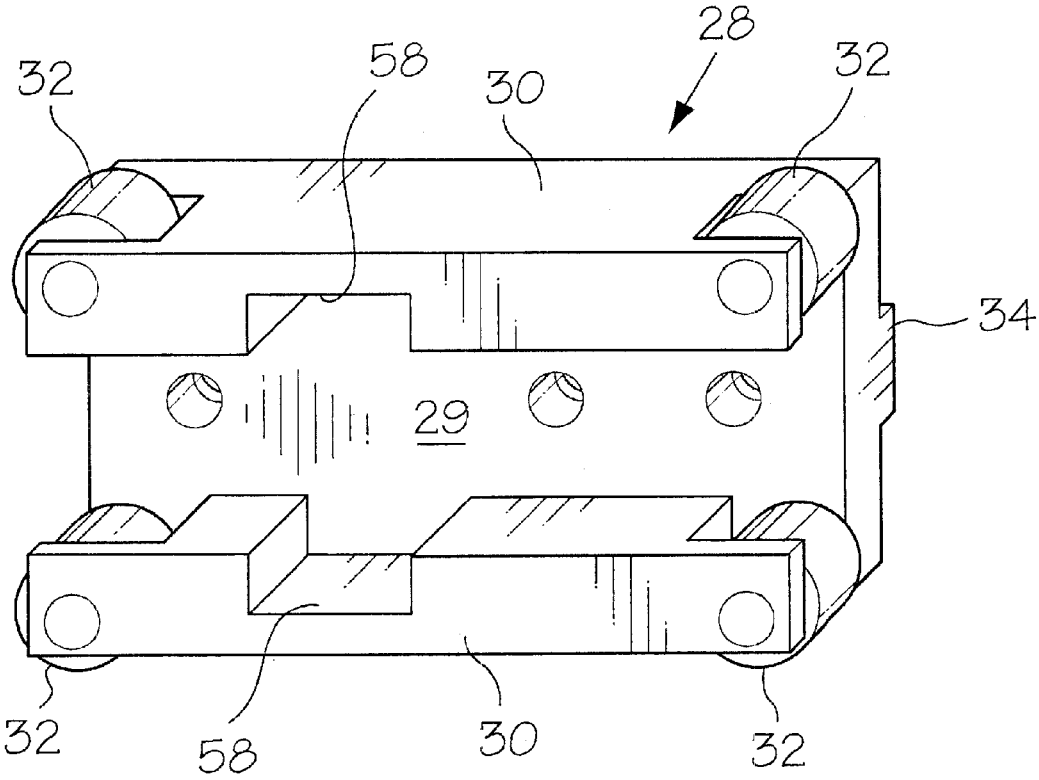
FIG. 6 is a perspective view of the carriage of FIG. 3 as seen from below.

The drill head 2 is carried by a saddle 14 which is moved longitudinally of the mast 1 by a hydraulic ram generally indicated at 15 (FIG. 5), which is described Kit hereinafter in greater detail. As best shown in FIGS. 3, 5 and 6, the saddle 14 is generally C-shaped in cross section, including a planar top wall 16, inclined 20 shoulders 17 and straight side walls 18. The top wall 16 of the saddle 14 rides on the top wall 19 of the mast 1, and the shoulders 17 ride on tracks 20 of the V-shaped cross section welded to the sides 21 of the mast 1.

Figure 4:
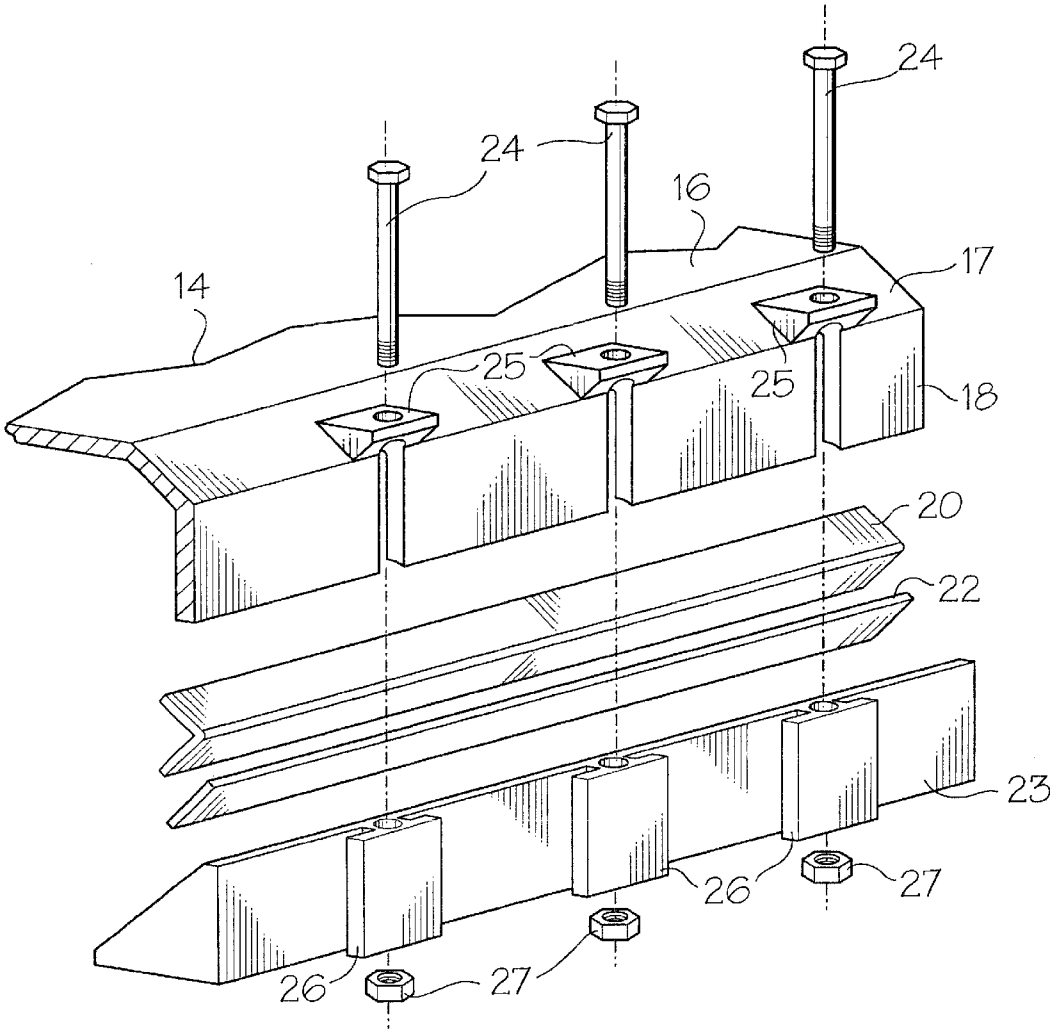
FIG. 4 is an exploded isometric view of a track and saddle retainer used in the apparatus of FIGS. 1 and 2.

Slides 22 defined by strips of ultra high molecular weight polyethylene (UHMWPE) are connected to the interior surfaces of the top wall 16 and the shoulders 17 of the saddle, and to the inclined top surface of a saddle retainer 23 (FIG. 4) to facilitate sliding. The saddle 14 is retained on the mast by bolts 24 extending through lugs 25 and 26 on the edges of the shoulders 17 and on the outer surfaces of the retainer 23, respectively and nuts 27 (FIG. 4).

The saddle 14 is connected to a carriage generally indicated at 28 which is moved longitudinally in the mast 1 by the hydraulic ram 15.

The carriage 28 is also generally C-shaped in cross section, including a top wall 29 and side walls 30. UHMWPE strips 31 (FIG. 5) mounted on the interior of the sides 21 of the mast 1 center the carriage 28 in the mast. Rollers 32 are mounted in recesses 33 in the ends of each side wall 30 of the carriage 28 for riding on the sides 21 of the mast 1. A rectangular cross section projection 34 extends along the length of the top wall 29 of the carriage 28. The projection 34 extends through an elongated slot 35 in the top wall 19 of the mast 1. Transversely extending notches 36 in the protection 34 receive transversely extending ribs 37 on the bottom of a rectangular spacer 38. The spacer 38 spaces the saddle 14 from the mast 1. A cylindrical post 39 on the top of the spacer 38 extends through the slot 35 in the mast hole 41 (FIG. 5) in a reinforcing plate 42, respectively welded to the top wall of the carriage. The post 39 helps to center the saddle 14 on the mast 1 during assembly. A plurality of bolts 43 extend through the reinforcing plate 42, the top wall 16 of the saddle 14 and the spacer 38 into the projection 34 and the top wall 29 of the carriage 28 to securely connect the saddle 14 to the carriage 28.

As mentioned above, the carriage 28 and consequently the saddle 14 and the drill head 2 carried thereby are moved longitudinally of the mast 1 by a main ram 15 which includes a cylinder 44 with a cap 45 on one end thereof carrying a hollow, generally cylindrical rod 46.

The other, internally threaded end 48 of the cylinder 44 is closed around the rod 46 by a sleeve 50 carrying a wiper 51, a high pressure seal 52 and an O-ring 53. The interior of the sleeve 50 is brass lined to facilitate sliding of the rod 46 therein. A pair of diametrically opposed, cylindrical trunnions 55 are used to connect the cylinder to the carriage 28. As shown in FIGS. 3 and 5, the trunnions 55 extend into swivel bushings 56 mounted in blocks 57, which slide in recesses 58 in the inside of the side walls 30 of the carriage 28. The swivel bushings 56 permit vertical movement of floating of the end 48 of the cylinder 44.

The threaded outer end 60 of the hollow rod 46 is closed by a manifold 61. Ports 62 and 63 in the manifold 61 introduce and vent hydraulic fluid from the end of the rod 46. A pair of holes 65 in the manifold 61 receive pins (not shown) for connecting the free outer end 60 of the rod 46 to the mast 1. Thus, when fluid is introduced into one of the ports 62 or 63 and discharged through the other, the cylinder 44 and consequently the carriage 28 are caused to move longitudinally of the mast 1. Movement of the carriage 28 is accompanied by sliding of the saddle 14 and the drill head 2 mounted thereon. When fluid is introduced through the port 62, it flows through a tube 66 in the piston rod 49 into a chamber 67 between the cap 45 and an aluminum sleeve 68 defining a piston head. The tube 66 is supported at one end by a sleeve 69 sealed in the port 62 by an O-ring 70 and at the larger diameter other end 71 by the rod 46. A steel ring 72 sandwiched between the sleeve 68 and a shoulder 73 on the piston rod 46 acts as a bearing surface for the piston 68. The sleeve 68 is sealed with respect to the piston rod 49 by an O-ring 74, and with respect to the cylinder 44 by a high pressure seal 75. Wear sleeves 76 are provided in the piston head.

When fluid is introduced into the port 63, it flows through a passage 77 between the interior of the rod 46 and the exterior of the tube 66 and then through radially extending holes 78 in the piston rod 49 into a chamber 80 between the sleeve 50 and the sleeve 68.

The cylinder 44 is caused to move in the opposite direction expelling fluid from the chamber 67 through the tube 66 and the port 62 in the manifold 61. Because the outer end of the piston 46 is fixed in the mast 1, the cylinder 44 is caused to move in the opposite direction (to the left in FIG. 7), causing a corresponding movement of the carriage 28, the saddle 14 and the drill head 2.

The conventional drill head 2 is used to rotate a drill rod 82 (FIG. 12) during the addition or removal of drill rod sections, or during a drilling operation. A suitable drill head 2 includes a 12HH underground chuck 83, a B15 or B15 gear box 84 and a drive tube 85 (all available from J. K. S. Boyles, North Bay, Ontario), and a hydraulic motor 86. The saddle 14, the carriage 28 and the main ram 15 are used to move/the drill head 2 and the drill rod 82 relative to the mast 1 during drilling or when removing the drill rod 82 from the ground.

A conventional rod clamp 3 of the type available from J. K. S. Boyles, North Bay, Ontario is used to clamp the drill rod 82 during the addition or removal of drill rod sections. It will be appreciated that the rod clamp 3 holds a first drill rod section stationary while a second section is rotated by the drill head 2 to attach the second section to the first section or detach the second section from the first section. The rod clamp 3 is securely mounted on one end of the mast 1 (the bottom end during drilling downwardly).

Figure 7:
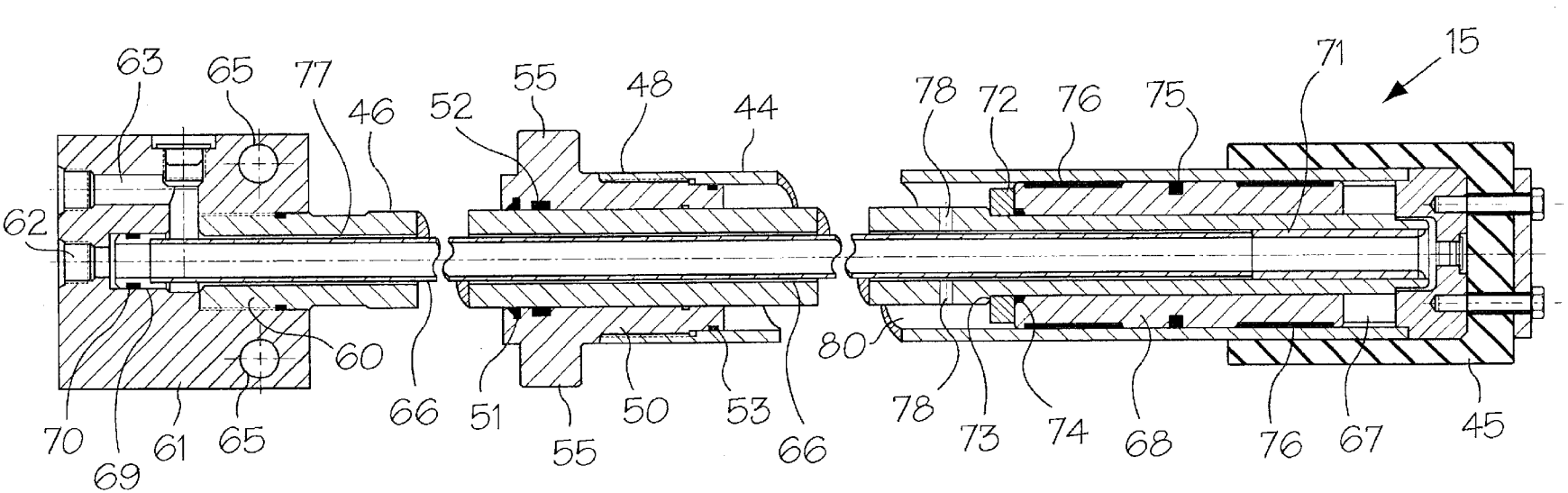
FIG. 7 is a longitudinal sectional view of a main ram used in the apparatus of FIGS. 1 and 2.
Figure 8:
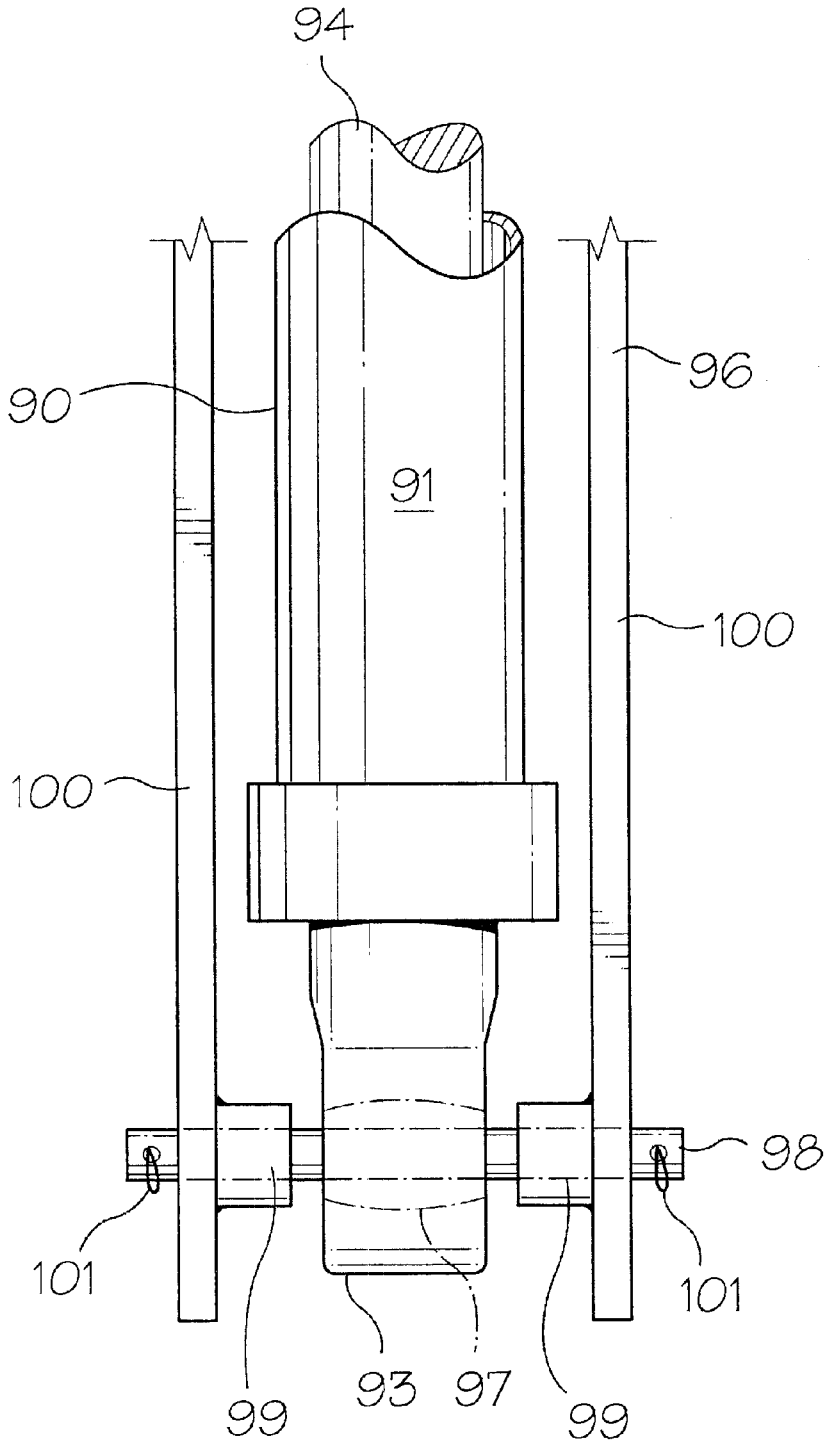
FIG. 8 is a plan view of one end of an auxiliary ram used in the apparatus of FIGS. 1 and 2.
Figure 9:
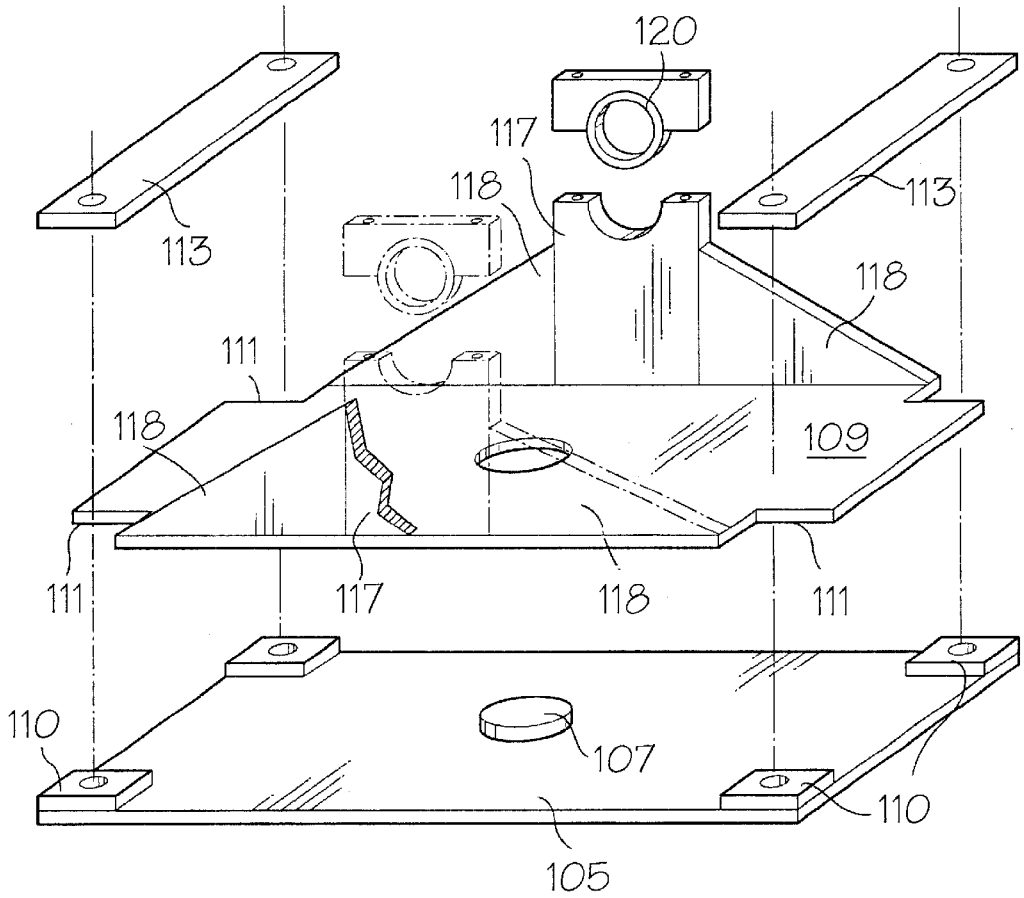
FIG. 9 is an exploded perspective view of a bracket used to connect the auxiliary ram to a rod clamp.

In order to balance the forces on the apparatus, an optional auxiliary ram 90 extends between the drill head 2 and the rod clamp 3. The auxiliary ram 90, which is parallel to the main ram 15, includes a hydraulic cylinder 91 mounted on the rod clamp 3. The free end 93 of a piston rod 94 extending out of the cylinder 91 connected to a bracket 96 on the top of the drill head 2 by a spherical bearing 97. The bearing 97 is mounted on a rod 98 extending through sleeves 99 welded to the sides 100 of the bracket 96. The rod 98 is held in the bracket 96 by cotter pins 101 (FIGS. 2 and 7). When the main ram 15 is actuated during a rod pulling operation, the auxiliary ram 90, which is parallel and spaced apart from the ram 15,is also actuated to balance the forces acting on the apparatus. A bracket generally indicated at 103 connects the cylinder 91 to the rod clamp 3 and permits limited pivoting of the auxiliary ram 90 around two axes, which are perpendicular to each other. For such purpose, the bracket 103 includes a baseplate 105 (FIGS. 9 and 10) connected to the rod clamp 3 by two end plates 106. A post 107 (FIG. 9) extends upwardly from the center of the base plate 105, and a swivel plate 109 is rotatably mounted on the post 107 between corner posts 110. There is clearance between the notched corners 111 of the swivel plate 109 and the posts 110 permitting limited rotation of the swivel plate 109 around the axis of the center post 107. The swivel plate 109 is retained on the baseplate 105 by a pair of crossbars 113, bolts 114 and nuts 115. A pair of posts 117 reinforced by gussets 118 extend upwardly from the sides of the swivel plate 109. Bearings 120 in the posts 114 rotatably support trunnions 121 extending outwardly from a band 122 extending around the cylinder 91. Thus, limited rotation of the auxiliary ram 90 around two axes perpendicular to the longitudinal axis of the rod clamp 3 is possible to compensate for any misalignment between the axis of the feed cylinder 14 and the auxiliary ram 90.

Figure 10:
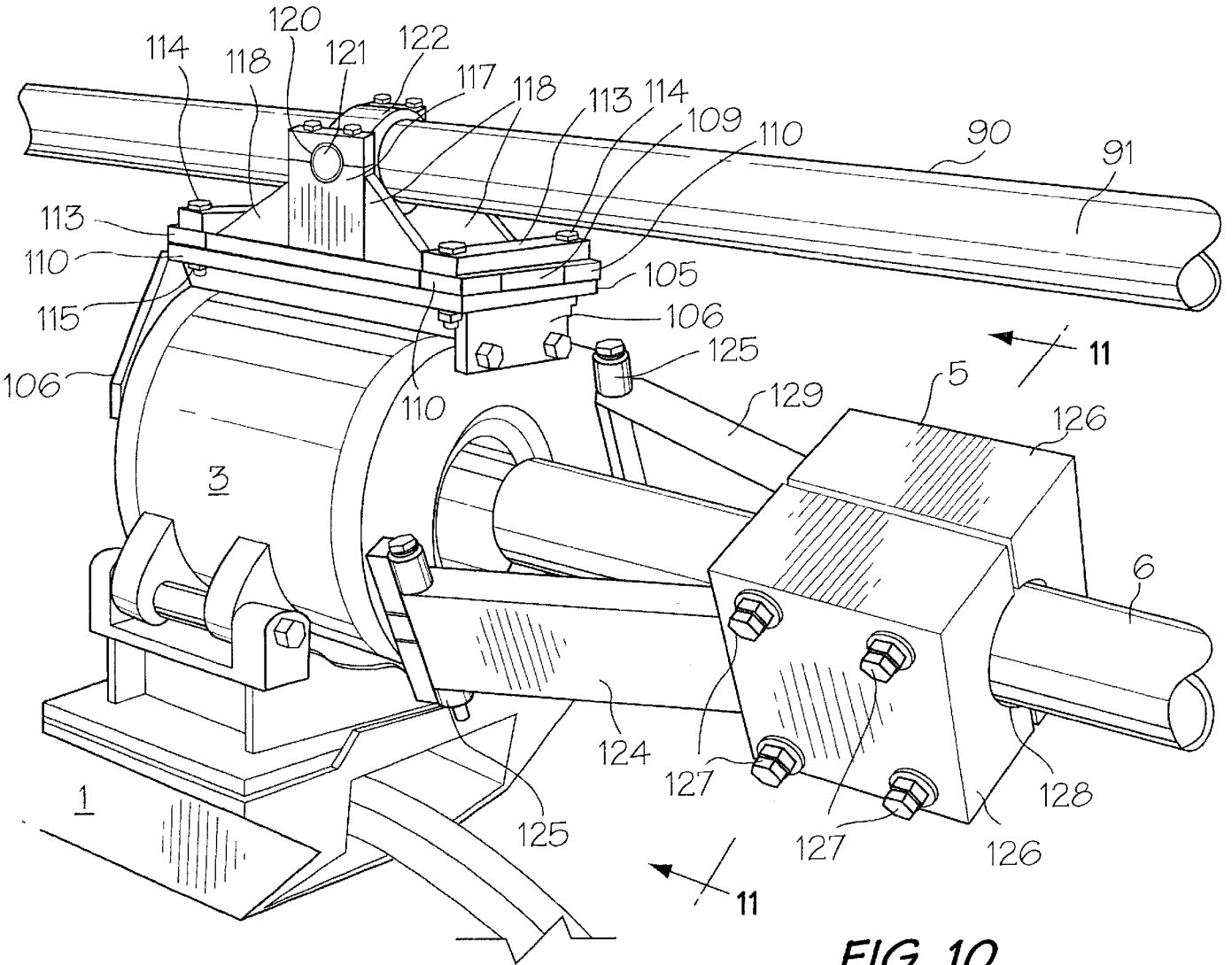
FIG. 10 is a perspective view of the rod clamp and a casing clamp used in the apparatus of FIGS. 1 and 2.
Figure 11:
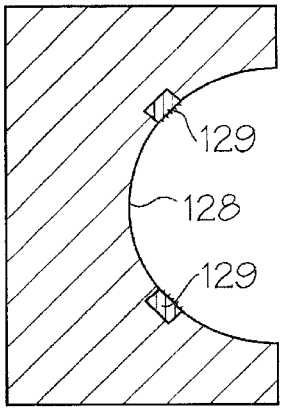
FIG. 11 is a cross section of one-half of the casing clamp of FIG. 10 taken generally along line 11—11 of FIG. 10.

As mentioned above, during a drilling operation the top end of a well casing 6 is secured to the mast 1 by a casing clamp 5. With reference to FIGS. 10 and 11, the casing clamp 5 includes a pair of arms 124 pivotally connected to the outer or bottom end of the rod clamp 3 by hinges 125. A jaw 126 is provided on the outer end of each arm 124. The jaws 126 are defined by rectangular parallelepipedic, metal blocks containing opposed, longitudinally extending, semicylindrical troughs 128. When the jaws 126 are bolted together using bolts 127 and nuts (not shown) the troughs 128 define a cylindrical passage for receiving the top end of the well casing 6. Toothed carbide inserts 129 (FIG. 11) in the troughs 128 firmly engage the casing 6 preventing relative movement between the jaws 126 and the casing 6.

Figure 12:
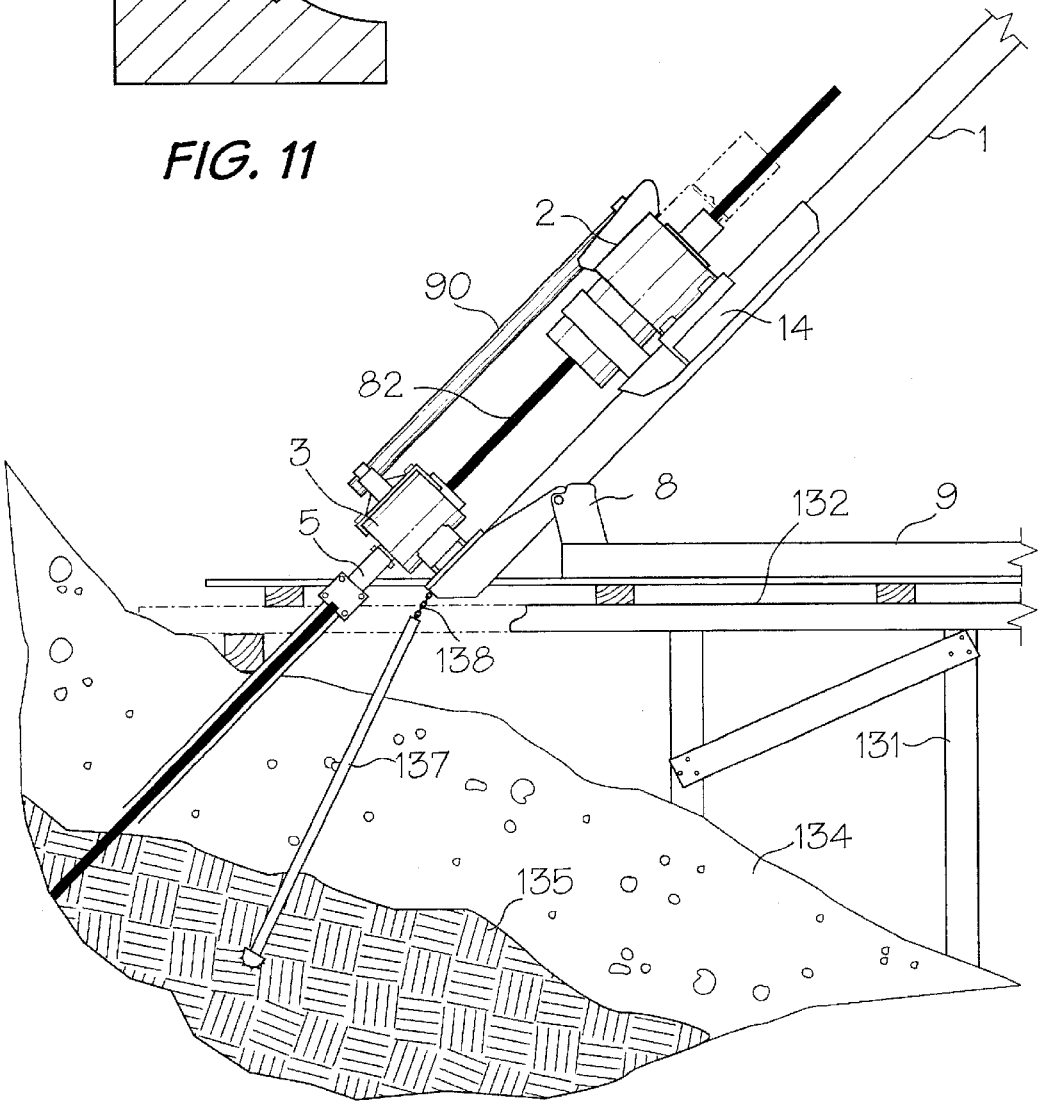
FIG. 12 is an schematic side view of the apparatus of FIGS. 1 and 2 during a drilling operation.

Referring to FIG. 12 as mentioned hereinbefore, if a remote drilling site has been chosen, the components of the drilling apparatus are carried to the site by helicopter in the order in which they are to be assembled. At the site, a platform 131 is constructed to support the apparatus of the present invention. The top 132 of the platform 131 is as level, i.e. as close to the horizontal as possible.

With the apparatus in position, the first step in the drilling process is to drill a hole in the ground 134. The hole is drilled into the bedrock 135 using an anchor rod 137. The rod 137 is burned in, i.e. drilled into the ground without water coolant until the bottom end of the rod melts into a ball at the bottom becoming one with the bedrock 135. A chain 138 is used to connect the top end of the rod 137 to the mast 1, and is tightened using a chain binder (not shown). The casing 6 is then drilled into the ground 134 until it also enters the bedrock 135.

A drill rod 82 is inserted into the drill head 2 passing through the rod clamp 3. Downward pressure on the drill rod 82 is exerted to tension the mast 1 and the rod clamp 3 with respect to the well casing 6. The casing clamp 5 is then closed on the upper end of the casing 6, i.e. the jaws 126 are bolted together. The result is a unitary structure defined by the mast 1, components on the mast 1, the well casing 6 and the anchor rod 137. With such a structure, drilling can be effected with relative little, if any movement of the platform 9. Any reaction forces generated during drilling or rod pulling are absorbed by the casing 6 and the anchor rod 137. During rod pulling or pull back, any forces are supported by the casing 6 via the clamp 5. Thus, the mast 1 cannot move and the platform 9 remains stationary, even on soft ground.

I claim:

1. A drilling apparatus for use with a well casing anchored in the ground at the start of a drilling operation, and a platform for positioning at a drilling site, said apparatus comprising:

(a) a mast for mounting on said platform for rotation between a horizontal non-use position and an inclined or vertical drilling position;

(b) a rod clamp fixedly mounted on one end of said mast for clamping a drill rod during the drilling operation;

(c) a casing clamp on said rod clamp including arms pivotally connected to said rod clamp, and opposed jaws on said arms for gripping a top end of the casing to clamp said mast to the casing, whereby the mast is anchored to the casing and the ground during the drilling operation;

(d) a drill head slidably mounted on said mast for movement toward and away from said rod clamp, said drill head being adapted to drive a drill rod during the drilling operation; and (e) a main ram connected to said mast and said drill head for moving said drill head longitudinally of the mast during the drilling operation, whereby drilling can be effected with relatively little movement of the platform due to reaction forces generated during drilling or rod pulling.

2. The drilling apparatus of claim 1, including an anchor rod for burning into bedrock at the start of the drilling operation, and a coupling for connecting one end of said mast to the anchor rod.

3. The drilling apparatus of claim 2, including an auxiliary ram extending between said rod clamp and said drill head, said auxiliary ram being parallel to and spaced apart from said main ram for applying balanced forces to a drill rod when pulling the drill rod from the ground.

4. The drilling at of apparatus claim 3, wherein said auxiliary ram is pivotally connected to said drill head and to said rod clamp for limited rotation, allowing for any misalignment between the main ram and the auxiliary ram.

5. The drilling apparatus of claim 1, including a saddle on said mast carrying said drill head; a carriage slidable in said mast and connected to said saddle for moving the saddle and the drive head along the mast, said main ram being connected to said mast and said carriage for driving the carriage in said mast.

* * * * *